US007925036B2

(12) United States Patent
Bouvier

(10) Patent No.: US 7,925,036 B2
(45) **Date of Patent: *Apr. 12, 2011**

(54) FOLDED COAXIAL TRANSMISSION LINE LOUDSPEAKER

(76) Inventor: Peter M. Bouvier, El Cerrito, CA (US)

( * ) Notice: Subject to any disclaimer, the term of this patent is extended or adjusted under 35 U.S.C. 154(b) by 324 days.

This patent is subject to a terminal disclaimer.

(21) Appl. No.: 12/200,695

(22) Filed: Aug. 28, 2008

(65) Prior Publication Data

US 2008/0317273 A1 Dec. 25, 2008

Related U.S. Application Data

(63) Continuation of application No. 11/476,351, filed on Jun. 28, 2006, now Pat. No. 7,436,972.

(51) Int. Cl.
*H04R 25/00* (2006.01)

(52) U.S. Cl. ..... 381/345; 381/338; 381/349

(58) Field of Classification Search ..... 381/87, 381/337, 338, 339, 345, 349, 351, 160; 181/148, 181/153, 155, 156, 160, 199
See application file for complete search history.

(56) References Cited

U.S. PATENT DOCUMENTS 2,949,163 A * 8/1960 Friedman ..... 181/199
3,529,691 A * 9/1970 Wesemann ..... 181/156
4,298,087 A 11/1981 Launay ..... 181/153
5,189,706 A 2/1993 Saeki ..... 381/349
6,144,751 A 11/2000 Velandia ..... 381/345
6,634,455 B1 * 10/2003 Yang ..... 181/156
7,436,972 B2 * 10/2008 Bouvier ..... 381/345

OTHER PUBLICATIONS

Matt Hills: "A Small Reflex TL," XPRESS Magazine, 2003. vol. 24, No. 3 Mar. 2003, Audio Amateur, Petersborough, NH.

T.S.Korn, A Corner Loudspeaker with Coaxial Acoustical Line, Journal of the Audio Engineering Society, Jul. 1957, vol. 5, No. 3, pp. 138-141.

* cited by examiner

*Primary Examiner* — Huyen D Le

(74) *Attorney, Agent, or Firm* — Procopio, Cory, Hargreaves & Savitch LLP

(57) ABSTRACT

A loudspeaker has a loudspeaker driver and a first tube having a base end coupled to the driver and extending towards the rear end of the loudspeaker. A second tube of larger cross sectional dimensions extends over the first tube and loudspeaker driver and has a rear end wall spaced from the open rear end of the second tube and a front end coupled to the driver. A third, open ended tube of smaller cross-sectional dimensions than the first tube extends through a rear end wall of the second tube and into the first tube, with the front end of the third tube spaced from the base of the first tube. A folded, three segment transmission line is formed between the first and second tubes, between the second and third tubes, and through the third tube.

10 Claims, 7 Drawing Sheets

FOLDED COAXIAL TRANSMISSION LINE LOUDSPEAKER

RELATED APPLICATION

The present application is a Continuation of co-pending U.S. patent application Ser. No. 11/476,351 filed on Jun. 28, 2006, and the contents of the aforementioned co-pending application is incorporated herein by reference in its entirety.

BACKGROUND

1. Field of the Invention

The present invention generally relates to a loudspeaker, and more particularly relates to a folded transmission line loudspeaker.

2. Related Art

Transmission Line ("TL") loudspeakers are a class of open-ended, or "ported" loudspeakers that perform as a phase inverter for the low frequencies, allowing the energy of the rear of the woofer cone to be combined with the energy of the front of the cone to enhance the low frequency performance of the system. The length of the "line" or audio transmission passage is typically set equal to the one quarter of the wavelength of the frequency of the free air resonant frequency of the driver. Therefore, this type of loudspeaker is sometimes referred to as a "Quarter Wave Tube."

One problem with transmission line loudspeaker design is the available space in the speaker system. A linear quarter wave tube would have a line length of nearly 34 inches for a driver having a free air resonant frequency of 100 Hz. Folded audio transmission passages have been proposed in the past but generally do not fit easily into modern manufacturing processes and are usually more expensive to build and larger than other known loudspeaker designs. The size of such devices typically makes them unsuitable for compact devices such as desktop computer speakers and portable media players.

SUMMARY

It is an object of the present invention to provide a folded coaxial transmission line loudspeaker.

According to one aspect of the present invention, a loudspeaker is provided, which has a folded coaxial transmission line formed by three interleaved tubes which extend coaxially or substantially coaxially to one another. The loudspeaker has a loudspeaker driver and a first tube having a first end or base secured to the driver and extending towards the rear end of the loudspeaker. A second tube of larger cross sectional dimensions extends over the first tube and loudspeaker driver and has a front end secured to the driver and a rear wall spaced from an open rear end of the first tube. A third, open ended tube of smaller cross-sectional dimensions than the first tube extends through a rear end wall of the second tube and into the second tube, with the front end of the third tube spaced from the base of the first tube.

The first tube and second tubes may be secured directly to the driver or may be secured to the driver via an intervening attachment device or coupling ring. This arrangement creates a folded, coaxial tube transmission line or audio passage having three co-axial segments, specifically a first segment between the first and second tubes extending from the front end of the outermost or second tube towards the rear end of the outer tube, a first fold extending between the rear end of the outer tube and the open rear end of the first tube, a second segment extending between the first and third tubes from the rear end of the first tube towards the base of the first tube, a second fold extending between the base of the first tube and the front end of the third tube, and a third segment extending from the front end to the rear end of the third tube.

In this embodiment, the first tube is secured to the back or base of the loudspeaker driver, so that the loudspeaker driver is used as an integral part of the transmission line and loudspeaker enclosure, producing a compact overall structure which does not extend any substantial distance outside the diameter of the loudspeaker driver. The "folded" coaxial arrangement of three tube segments produces a loudspeaker which has a length approximately one third that of an unfolded transmission line. The tubes forming the transmission line segments are spaced apart and do not contact one another.

The loudspeaker may be made in two parts which are then secured together by adhesive, welding, or other securing devices or fasteners. The first part comprises the driver and first tube. The second part comprises the second or outer tube and the third or inner tube which are secured together at the rear end of the outer tube. The second and third tubes may be formed separately and then secured together, or may be molded in one piece. The two parts are then brought together so that the first tube extends into the front end of the outer tube and over the third tube. The tubes are of different lengths such that they can be interleaved with the oppositely directed open ends of the first and third tubes spaced from the respective closed ends of the second and first tubes.

In one embodiment, the third tube is open at its rear or outer end, forming the end of the audio passage or transmission line. In another embodiment, a four segment transmission line is provided by means of a fourth tube or housing of larger cross sectional dimensions than the second tube. The fourth tube engages over the other tubes and has an end wall spaced from the second end of the third tube, to form a fourth transmission line or audio passage segment extending between the second and fourth tubes to the front end of the loudspeaker.

The loudspeaker may use a tiny, full-range driver and lends itself to applications such as desktop computer speakers and speakers for portable media players such as iPod® players, where space is at a premium. In these applications, separate subwoofers can be used to reproduce extremely low frequencies.

The three tubes of the loudspeaker in the first embodiment define a twice-Folded Coaxial Tapered Quarter Wave Tube Transmission Line ("FoCoTTL"). Because the transmission line is folded twice (at the junction between the first and second tubes and the junction between the first and third tubes), the overall depth of the loudspeaker is reduced to just over one-third of the length of the transmission line. One or more of the tubes may be tapered between their opposite ends. The tapered design of the loudspeaker can provide a much better damping of higher harmonics than the designs having straight and/or expanding enclosures. Also, the tapered transmission line design can produce a more uniform bass response.

In one embodiment, the tubes may be of generally round cross-sectional shape. In this case, area is calculated based on the area of a circle. Since the transmission line inside the loudspeaker is folded twice, the overall length of the structure is reduced significantly, to just over one third of the total transmission line length L. The overall length of the loudspeaker enclosure is the "L/3+2r," where "L" is the length of the transmission line and "r" is the radius of the tube at a fold point in the line.

Other features and advantages will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a compact transmission line loudspeaker that uses a loudspeaker driver as an integral part of the transmission line. In one embodiment, the arrangement improves upon and increases the performance of the loudspeaker within a constrained spatial envelope. The sound quality of the speaker system is enhanced by the creation of a cylindrical enclosure whose outside diameter is only minimally larger than the outside dimensions of the front profile of the driver, and whose depth is greatly reduced.

After reading this description it will become apparent to one skilled in the art how to implement the invention in various embodiments and alternative applications. Although various embodiments of the present invention will be described herein, it is understood that these embodiments are presented by way of example only, and not limitation. As such, this detailed description of various embodiments should not be construed to limit the scope or breadth of the present invention as set forth in the appended claims.

Figure 1:
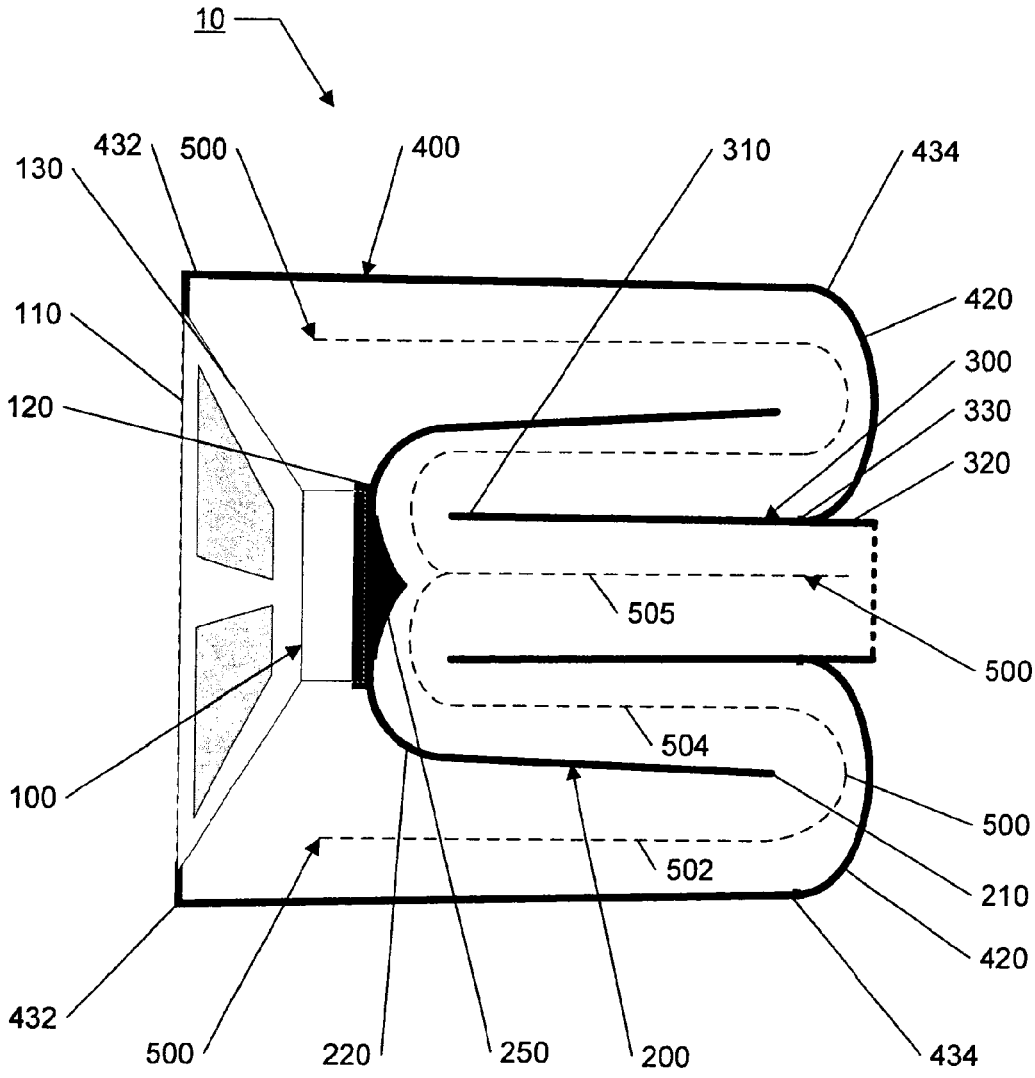
FIG. 1 is a cross-sectional not-to-scale view of a compact, coaxial transmission line loudspeaker according to an embodiment of the present invention.
Figure 2:
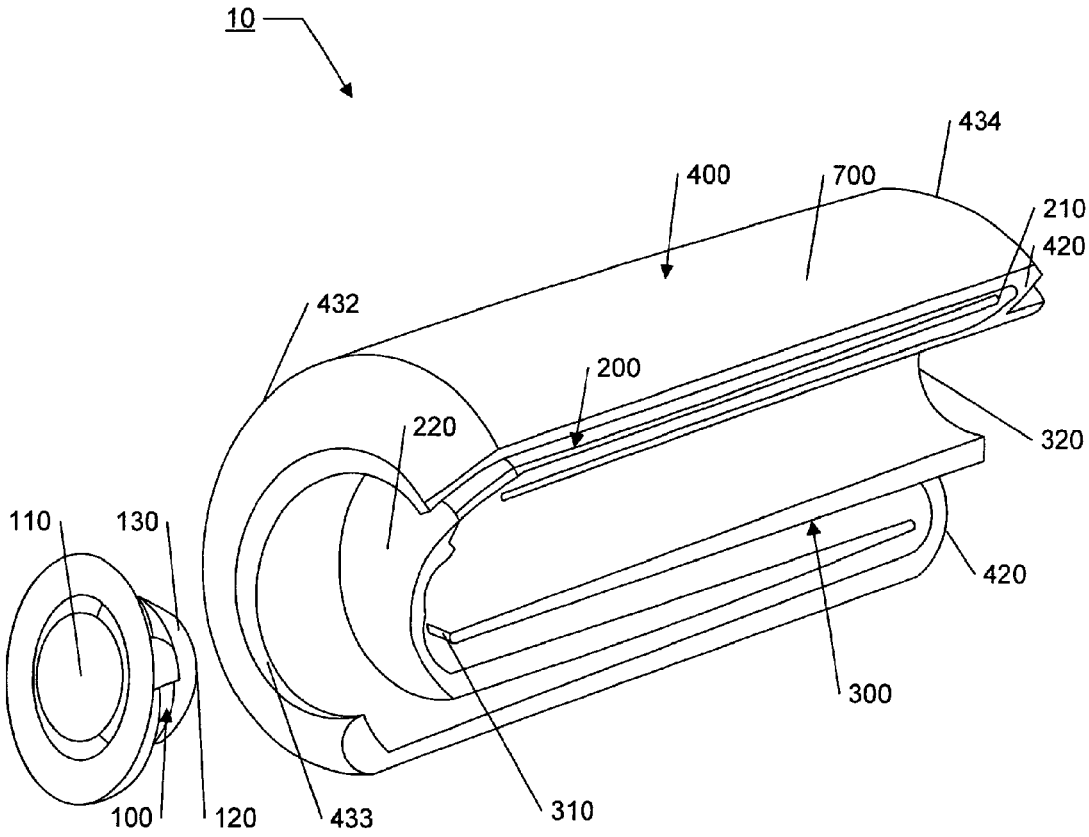
FIG. 2 is a partially cut away perspective view of the loudspeaker of FIG. 1, with the loudspeaker driver shown separate from the remainder of the loudspeaker enclosure.
Figure 3:
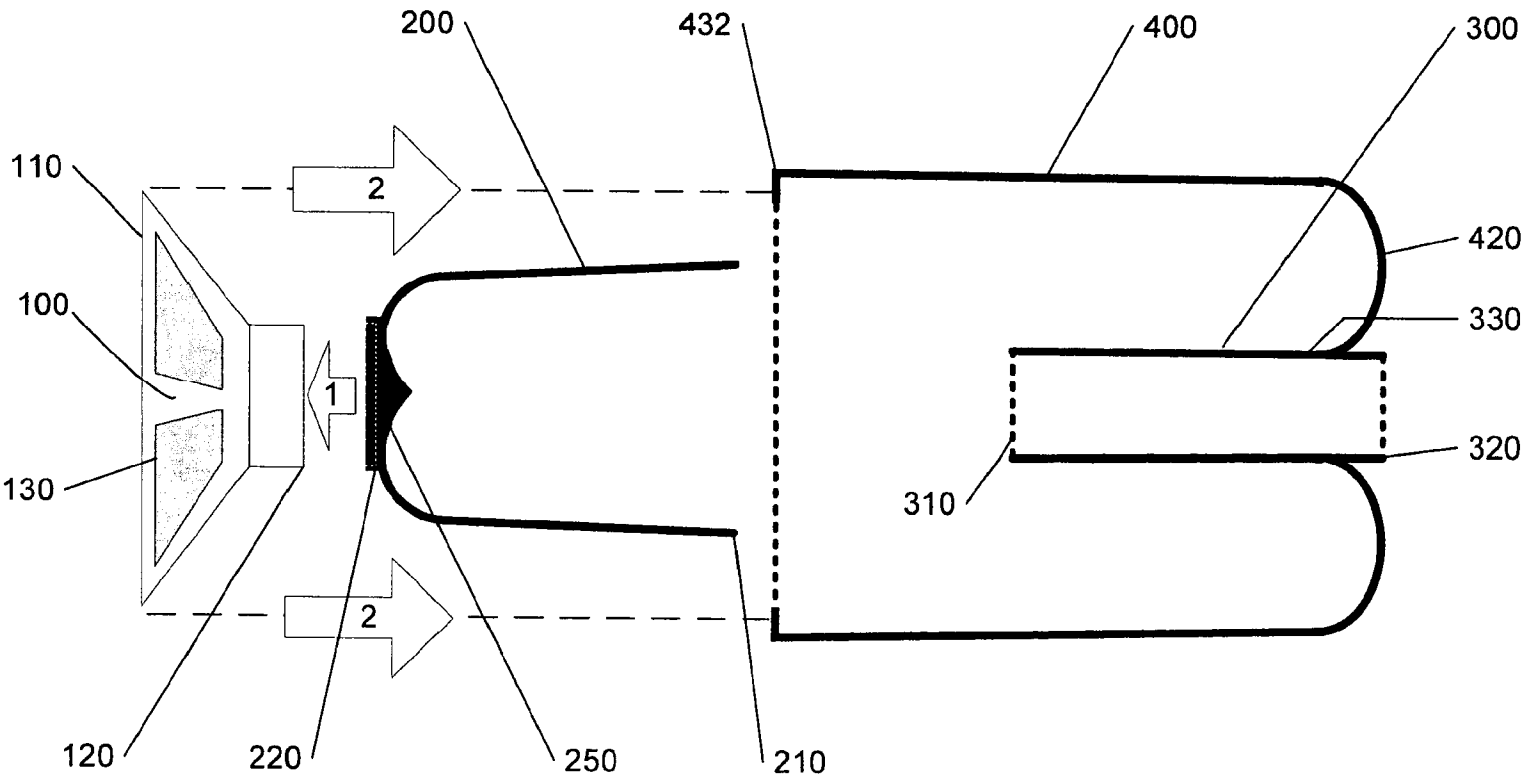
FIG. 3 is an exploded cross-sectional view illustrating parts of the loudspeaker separated prior to assembly.
Figure 4:
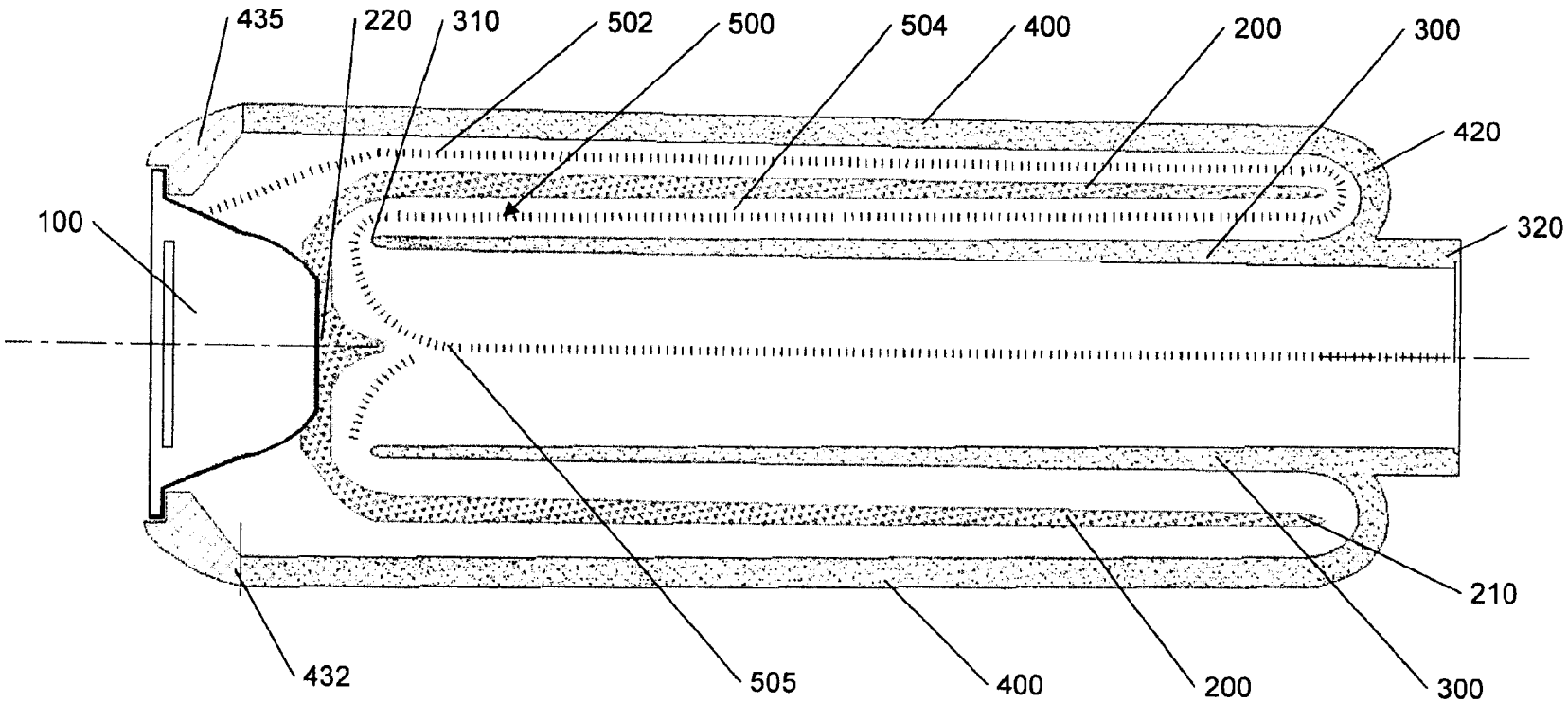
FIG. 4 is a more detailed longitudinal cross-sectional view of the loudspeaker of FIG. 1.

FIGS. 1 to 4 illustrate a folded transmission line loudspeaker 10 according to a first embodiment of the invention. FIGS. 1 and 4 illustrate the assembled loudspeaker, while FIG. 2 illustrates the loudspeaker driver 100 separated from the remainder of the loudspeaker and FIG. 3 illustrates separated parts of the loudspeaker prior to assembly, as will be described in more detail below. The loudspeaker enclosure in this embodiment comprises three tubes 200, 300, 400 which are coaxial or substantially coaxial with one another. The first tube 200 has a closed first end or base 220 which is secured to the base 120 of the loudspeaker driver 100 and extends towards the rear or back end of the loudspeaker, terminating at an open rear end 210 which is spaced from the rear end of the loudspeaker. Tube 200 may be tapered outwardly from its first end to its rear end in a generally frusto-conical shape, as illustrated in FIGS. 1 and 4.

The second, outer tube or cover 400 has a first or front end 432 with an opening 433 in which the front end 110 of the loudspeaker driver is mounted, as best illustrated in FIGS. 2 and 4. The outer tube may be bent inwardly at its rear end 420 to connect to the inner or third tube 300 adjacent the open rear end 320 of the inner tube. Inner tube 300 is open at its front end 310, and front end 310 is spaced from the adjacent base 220 of the first tube 200. This arrangement of three coaxial or substantially coaxial tubes integrated with the loudspeaker driver creates a transmission line or audio passageway 500 with three interleaved or folded segments 502, 504 and 505, as illustrated by the dotted line in FIGS. 1 and 4.

The driver 100 can be a typical loudspeaker driver. It includes a front face 110 at a first end, a base 120 opposite the front face 110, and a basket 130 extending from the front face 110 of the driver 100 to the base 120 of the driver 100. The basket 130 is adapted to couple the front face 110 of the driver 100 to the base 120 of the driver 100.

The base 220 of the first tube 200 may be shaped to form a deflector plug 250. Alternatively, the deflector plug 250 can be a separate component attached to the bottom part of the tube base 220. The deflector plug is of conical shape with a concave curved surface to form a rounded junction or bend in the transmission line from segment 504 to segment 505.

The tube 200 may be mechanically coupled to the driver 100. In one embodiment, the tube base 220 is coupled to the base 120 of the driver 100. The coupling is preferably sufficiently rigid and strong so as to completely support the tube 200. For example, the coupling can be accomplished with an adhesive or with one or more mechanical fasteners.

In the embodiment illustrated in FIGS. 1 to 4, the longitudinal axes of the three tubes are aligned or co-axial, and are also aligned with the central axis of the loudspeaker driver 100. Although the tubes are aligned in the illustrated embodiment, one or more of the tubes may be slightly offset from the central axis of the loudspeaker in alternative arrangements, as will be described in more detail below in connection with FIGS. 5A to 5C. Therefore, for the purpose of this application, "coaxial" means that the tube axes are either coincident or are parallel and closely adjacent one another without being exactly coincident. Aligning the axes means that they are approximately parallel and are closely adjacent or coincide.

The second and third tubes 400, 300 may be of uniform cross-sectional dimensions or may be slightly tapered or conical between their opposite ends. In the illustrated embodiment, the outer cover or second tube 400 is tapered slightly outwardly from its rear end 420 to the front or first end 432 in which the loudspeaker driver is mounted. The innermost or third tube 300 is tapered slightly outwardly from its rear end 320 to its inner or front end 310. The tapered transmission path design may produce more uniform bass response.

The three tubes are of circular or round cross-section in the illustrated embodiment but alternative cross-sections may be used in alternative embodiments. One or more of the tubes may have cross sectional shapes which are rectangular, oval, polyhedral, eccentric or unsymmetrical. Examples of some cross sectional shapes are illustrated in FIGS. 5A-5C.

Figures 5A, 5B, 5C:
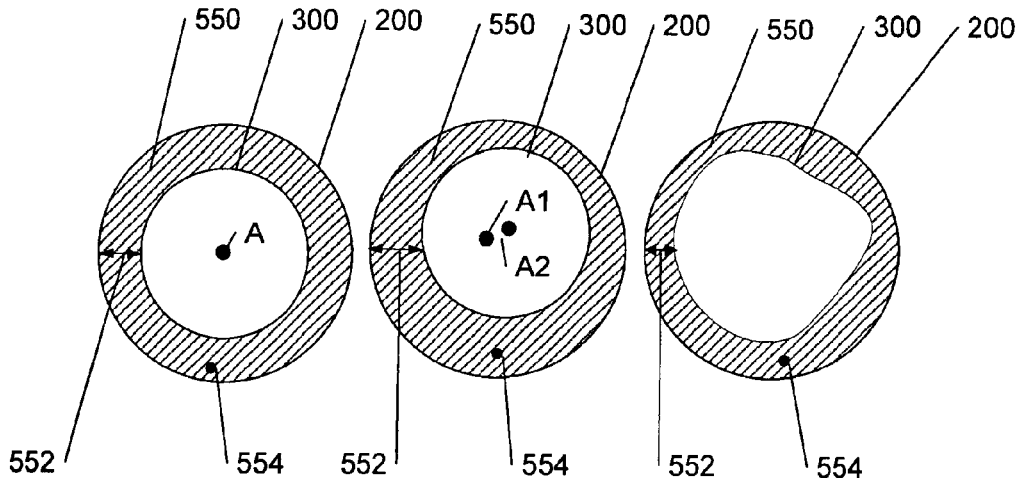
FIGS. 5A to 5C illustrate alternative cross-sectional dimensions of the transmission line and relative positions of the first and second tubes in alternative configurations of the loudspeaker of FIGS. 1 to 4.

FIGS. 5A-5C are transverse cross-sectional views illustrating alternative arrangements of the inner or third tube 300 and first tube 200, with the section lines illustrating the cross-sectional area 550 at one point of the passageway or line 500 defined between the two tubes. As seen in these drawings, the passageway is generally ring-shaped or annular along the first two segments of its length. The spatial relation between the tubes 200 and 300 has an impact on the performance of the loudspeaker. For example, the shape and position of the tube 300 relative to the tube 200 impacts acoustic nodes of the loudspeaker.

Ring 550 between the two tubes has a width 552 and a ring cross-section area 554. In the embodiment illustrated in FIG. 5A, the width 552 of the ring 550 is constant around the perimeter of the ring 550 because the cylinder 300 and the tube 200 are concentrically aligned, e.g. the inner tube 300 has its longitudinal central axis A coaxially aligned and coincident with the longitudinal central axis of the tube 200.

In the embodiment illustrated in FIG. 5B, ring or passageway 550 is eccentric, and the width 552 of the ring 550 varies along the perimeter of the ring 550 because the inner tube 300 and the first tube 200 are not concentrically aligned, e.g. the longitudinal central axis A2 of the tube 300 does not coincide with the longitudinal central axis A1 of the tube 200. In the embodiment illustrated in FIG. 5C the thickness 552 of the ring 550 varies along the perimeter of the ring 550 because tube 300 has an irregular cross-sectional shape.

In the embodiments where the width 552 of the ring 550 varies along the perimeter of the ring 550 (FIGS. 5B and 5C) the resonance is usually lower than in embodiments where the width 552 of the ring 550 is constant (FIG. 5A). Designing a loudspeaker with minimized constant dimensions (e.g. the width 552), results in a loudspeaker with minimal resonances. Since the entire structure of the enclosure can be created by a computer, the computer can also generate non-uniform shapes of enclosures like the one illustrated in FIG. 5C. This may be done for the first and second tubes as well as for the first and third tubes.

FIG. 3 illustrates a method of assembling the loudspeaker of FIGS. 1,2 and 4. The loudspeaker may be initially formed in two separate parts, with one part comprising the loudspeaker driver 100 and first tube 200, and the other part comprising the second and third tubes 400, 300. The first tube 200 may be formed by molding or the like and the closed base 220 may then be joined to the base 120 of the loudspeaker 100, as indicated by the arrow 1 in FIG. 3. Base 220 has an indented forward end, as indicated by the dotted lines in FIG. 3. This is seated over the base 120 of the loudspeaker and aligns tube 200 with the base 120 for proper alignment with tubes 300 and 400.

The second and third tubes may be formed separately and then joined together by adhesive, welding, fasteners or the like, or may be molded in one piece. In the former case, the outer or second tube may be bent or folded inwardly at one end to form rounded rear end wall 420 with an opening, and then connected to the third tube 300 at junction 330. It can be seen that the tube 300 is open at both ends and the junction between end wall 420 and tube 300 is spaced a short distance from the open outer or rear end 320 of tube 300. Alternatively, the inner and outer tubes 300, 400 and end wall 420 may be molded in one piece in a suitably shaped mold, as indicated by the uniform shading of these parts in FIG. 4.

The two parts of the loudspeaker may then be assembled as indicated by the arrows 2 in FIG. 3. The parts are aligned with one another, with the open rear end 210 of tube 200 facing the open front ends of tubes 300 and 400, and the parts are moved together so that tube 200 is inserted telescopically into outer tube 400 and over inner tube 300, until the outer face 110 of the loudspeaker driver is adjacent the open front end 432 of the outer tube 400. The front end 432 of outer tube or cover 400 is then coupled to the outer diameter of the outer face 110 of the loudspeaker driver. An annular coupling ring 435 may be used for this purpose, as illustrated in FIG. 4. The ring 435 may be secured to the open end 432 of the tube 400 and to the loudspeaker driver 100 in any suitable manner, for example using mechanical fasteners, adhesive, or the like.

As can be seen in FIG. 4, when the parts are assembled together, the open rear end 210 of tube 200 is spaced a short distance from the end wall 420 and the open front end 310 of tube 300 is similarly spaced a short distance from the base 220 of tube 200, so that a continuous passageway or transmission line 500 extends from the loudspeaker driver 100 along the space between tubes 200 and 400 (502), around the open rear end 210 of tube 200, along the space between tubes 300 and 200 (504), around the open front end of tube 300, and along tube 300 (505).

In one embodiment, the driver 100 and tubes 200, 300, and 400 are formed using modern forming techniques. These techniques allow forming the enclosure structure which has front-profile outside dimensions which are only minimally larger than the front face 110 of the driver 100.

The driver 100 and the coaxial tubes 200, 300 and 400 define a Folded Coaxial Tapered Quarter Wave Tube Transmission Line ("FoCoTTL"), which extends from the driver 100 through the second end 320 of tube 300 and is generally indicated by the dashed line 500. Because the transmission line is folded and coaxial, the overall length of the loudspeaker enclosure 10 is reduced significantly to just over one-third of the length of a linear Tapered Quarter Wave Tube ("TQWT").

The folded tubular passageway 500 may be filled with a filling material, also called "stuffing." The filling material may be acrylic fiber at a volume of around 4 oz per cubic foot. The main purpose for filling the passageway or transmission line 500 with filler material is to include reflective surfaces to the line, and thus to effectively reduce the speed of sound sent from the driver to the transmission line.

In one embodiment, the stuffing is distributed evenly throughout the tube and is held in place by spraying an adhesive to the tube and applying the stuffing to the sides of the tube in sheets or layers. This can prevent the stuffing from bunching and shifting.

The loudspeaker structure may be designed to create an electronic comb filter that passes some frequencies of the sound generated by the driver and filters out others. The filter parameters can be smoothed out with parametric equalization applied to the filter to account for the characteristics of the loudspeaker and the characteristics of the "stuffing" used to fill the transmission line. The parameters for the equalizer can be computed at the final phase of the loudspeaker assembly process.

The loudspeaker 10 may be cylindrical in one embodiment. In this case, the loudspeaker area is calculated based on the area of a circle, although it will be understood that other loudspeaker shapes may be used in alternative embodiments. The transmission line or passageway 500 in FIGS. 1 to 4 is folded twice: Once at the open end 310 of tube 300 and once at the open end 210 of tube 200. Therefore, the overall length of the enclosure is approximately equal to L/3+2r, where "L" is the length of a quarter wave transmission line, and "r" is the radius of the transmission tube at the fold points in the line. Note that in some embodiments the radii of the transmission tube at the folds may not be equal, due to the tapering of the transmission tube, for example.

In one embodiment, the transmission line 500 is tapered throughout its length. Alternatively, the tapering can follow other patterns selected to produce a desired response. In the embodiment illustrated in FIGS. 1 to 4, the outer tube 400 is tapered so that the radius of the first end 432 is larger than a radius of the second end 434. The tube 200 and/or the tube 300 may be tapered as well. The amount of tapering can be selected so as to dampen the higher harmonics and enhance the frequency (or frequency range) of interest, using computer modeling techniques.

The FoCoTTL may be an ultra-compact loudspeaker 10 in one example. In this case, the loudspeaker driver 100 is an ultra-compact driver and the dimensions of the outer tube 400 are also ultra-compact and only slightly larger than the dimensions of driver 100. The outside dimensions, front-view dimensions and the outside front-view dimensions of the FoCoTTL loudspeaker 10 are arranged to meet the requirements of an ultra-compact loudspeaker.

In one embodiment, the loudspeaker driver is a tiny, full-range driver 100 having a diameter of 95 millimeters. Since the area of the tubes 300,200 and 400 will depend on the effective piston area ("EPA") of the driver 100, the small driver 100 with a small EPA requires a small tube area. A typical small, full-range driver has also a higher free-air resonance ("fs"), a short FoCoTTL, and thus, a small overall size. The ultra-compact loudspeaker 10 is useful in applications such as desktop computer speakers and iPod® monitors, where space and style are a premium, and where extreme low frequencies can be reproduced by separate subwoofers.

In another embodiment, the loudspeaker may have a large loudspeaker driver 100. In comparison with small drivers, larger drivers have larger EPAs, lower fs, and thus, require enclosures having larger area and longer transmission lines. Since very large drivers may be unable to generate high-frequencies, the embodiments comprising larger drivers may also comprise an additional high-frequency driver.

Figure 6:
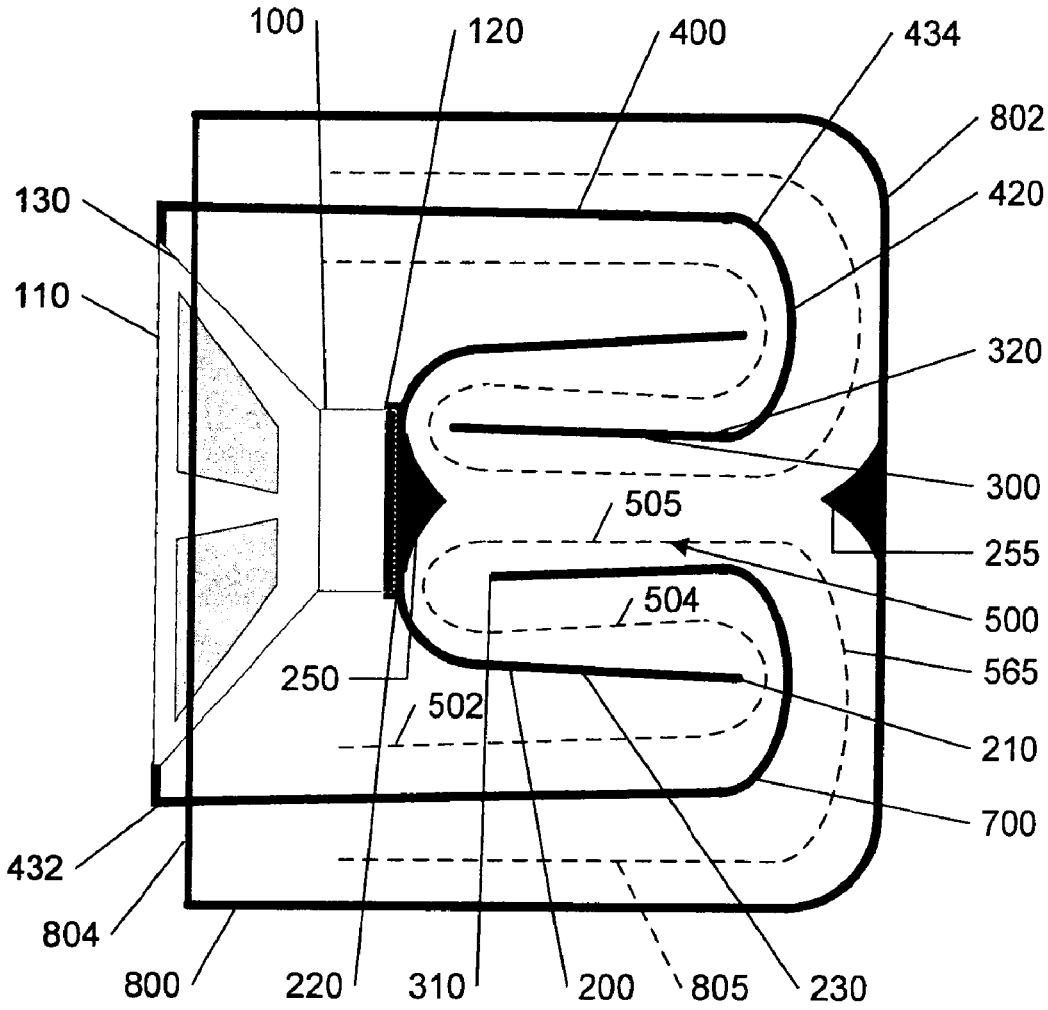
FIG. 6 is a longitudinal cross-sectional view of a transmission line loudspeaker according to another embodiment of the present invention.

FIG. 6 is a cross-sectional view of a compact transmission line loudspeaker 60 according to another embodiment of the present invention, which has four folded transmission line segments rather than three. The loudspeaker 60 comprises the three segment unit of the previous embodiment, with like reference numerals used for like parts as appropriate, and an outer, larger diameter tube 800 engaged over the three segment unit to form a fourth segment 805 of the transmission line between the tube 400 and the larger outer tube 800. Tube 800 has a closed rear end 802 and an open front end 804, and the open end is engaged over the three segment loudspeaker unit from the rear. The closed rear end wall 802 of tube 800 is spaced from the closed or folded in end portion 420 of tube 400 to provide a passageway from segment 805 to the inside of the inner tube 300, as indicated by the dotted lines in FIG. 6. With this arrangement, the transmission line or audio passageway terminates at the front of the loudspeaker rather than at the back as in FIGS. 1 to 4, and has four segments 502, 504, 505 and 805. In this case, each segment will have a length of the order of L/4, where L is the length of the quarter wave transmission line.

From the installation point of view, if minimizing the overall depth of the loudspeaker 10 is critical, the use of shorter segments is desirable, and this can be done by increasing the number of folded line segments, as in FIG. 6.

In one embodiment, the inner surface of the base or end wall 802 of the outer tube 800 has a second deflector plug 255 at its center, facing the tube 300. Deflector plug 255 is of a similar cone shape to opposing deflector plug 250. Plug 255 deflects the FoCoTTL from the third segment 505 of the line 500 toward the fourth segment 805. The second deflector plug 255 is opposite to the deflector plug 250 attached to the base of tube 200. The second deflector plug 255 can be formed as one piece with the outer tube 800. Alternatively, the deflector plug 255 can be a separate part attached to the inner surface of end wall 802 of the outer tube 800. The two deflector plugs, one at each fold in the transmission line, help to direct or deflect the airflow around the respective folds.

The outer tube 800 may be attached to the outer surface of the 3-segment tube by screwing the outer tube onto the outer surface of the 3-segment tube. The outer tube 800 may have a few rubber ribs circularly positioned on the inner surface of the outer tube and matching rubber ribs may be circularly positioned on the outer surface of tube 400. The outer tube can be screwed along the rubber ribs until a tight fit between the inner tube and the outer tube is achieved. Alternatively, the ribs and the outer tube can be glued together.

Figure 7:
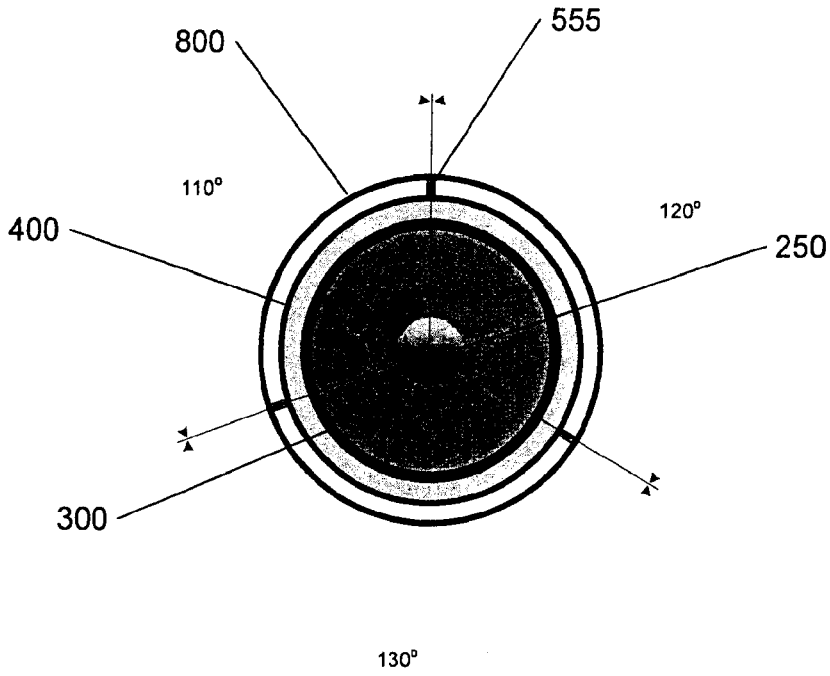
FIG. 7 is a transverse cross-sectional view of the transmission line of FIG. 6.
Figure 8:
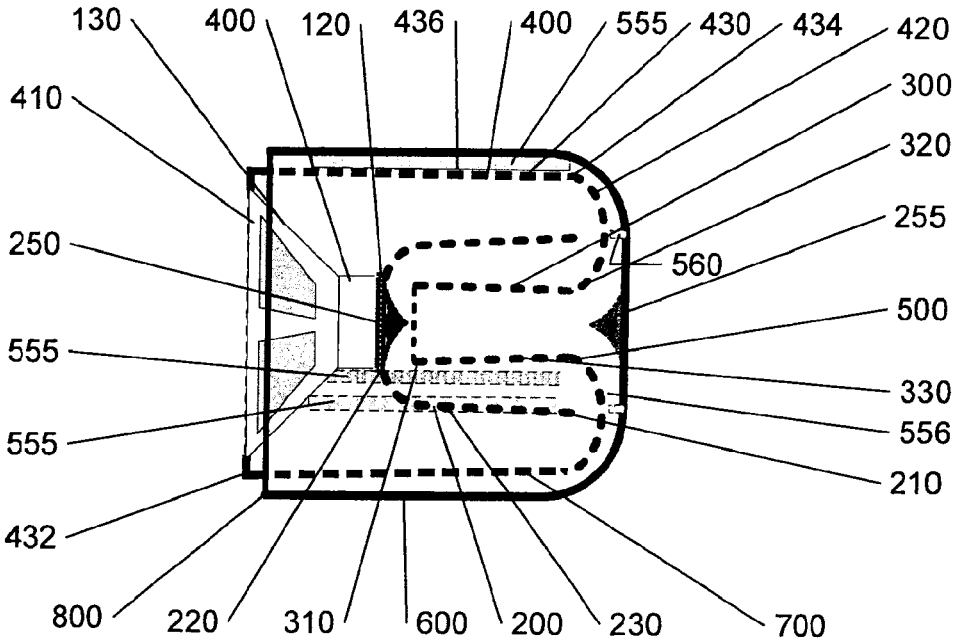
FIG. 8 is a cross-sectional view similar to FIG. 6 but on a reduced scale, and illustrating spacers between adjacent tubes.

FIGS. 7 and 8 are transverse and longitudinal cross-sectional views of an embodiment of the four segment loudspeaker 60 with spacers or ribs 555. Spacers 555 may be of rubber or other similar material, and may be used to attach the outer tube 800 to adjacent tube 400. In this embodiment, outer tube 800 is a pressure fit over the tube 400 and spacers 555. Additional rubber spacers 560 may be used to register the proper dimension at the fold 565 of the transmission line 500. The rubber spacers or ribs 555 are positioned at circumferentially spaced intervals about the tube 400, as illustrated in FIG. 7, and three such spacers are provided in this embodiment. The rubber spacers 555 may be positioned at unequal angular distances about the tube 400. In the embodiment illustrated in FIGS. 7 and 8, three rubber spacers 555 are placed between the tubes 400 and 800. The angular distances between the spacers 555 are 110 degrees, 120 degrees and 130 degrees respectively.

In one embodiment, to create a desired shape for the transmission line, the tubes can be bent (or "squinted") in a variety of ways as long as (1) the area of the airspace or transmission line at a first end is about 1.25 times larger than the effective piston area of the driver, (2) the area of the transmission line tapers to 0.75% of the EPA at the second end of the line, and (3) the length of the outer tube 400 in the first embodiment is about ⅓ of the free-air resonance wavelength of the driver, and the length of the fourth tube 800 in the embodiment of FIGS. 6 to 8 is about ¼ of the free-air resonance wavelength of the driver. In each embodiment, any of the tubes may be tapered and may be offset or irregularly shaped, for example as illustrated in FIGS. 5B and 5C, in order to vary the cross-sectional shape of the transmission line 500.

In each of the above embodiments, the characteristics of the enclosure defining the transmission line impact the performance of the loudspeaker. For example, minimizing common dimensions of the tube 200 minimizes acoustic nodes of the loudspeaker. The smaller the dimensions of the tube 200, the fewer acoustic nodes (resonances) are generated by the loudspeaker. Because the transmission line characteristics 500 can be modeled and designed by a computer, the computer can also be used to minimize and randomize dimensions of the tubes, and subsequently to minimize resonances.

Some of the important aspects of the loudspeaker include the tube area and overall length of the tube. For example, if the transmission line 500 is folded into three segments, as in FIGS. 1 to 4, it is best if all three segments have different lengths. For example, a 30" transmission line folded into three segments having lengths L1, L2 and L3 where L1≠L2≠L3, has less resonance than a 30" deep three-segment transmission line where L1=L2=L3. Thus, it is better to have a three-segment transmission line whose segments have lengths 9", 10" and 11" respectively, for example, than to have a three-segment transmission line whose segments have equal lengths (10", 10" and 10"). A transmission line consisting of three 10" long segments would have a node (peak in response) at approximately 1,240 Hz (and corresponding dips in response above and below 1,240 Hz as the wavelengths cancel). The relative lengths and overlaps between the tubes 300, 200 and 400 (and outer tube 800 if present) can be designed in order to produce unequal length segments as desired, for example using computer modeling techniques.

In one embodiment, the concept of minimizing common dimensions is carried even further, and a 30" deep transmission line is designed to have three segments with lengths 8", 10" and 12" respectively. In another embodiment, a 27" deep transmission line has three segments having lengths 9", 8.5", and 9.5" respectively. However, in both instances, the manufacturing of enclosures having segments with such substantially different lengths is usually difficult.

As noted above, the three segment folded coaxial loudspeaker of FIGS. 1 to 4 may be manufactured by molding the two separated parts of FIG. 3 in suitably shaped molds. It will be understood that the outer tube 800 of the four segment loudspeaker of FIG. 6 may also be manufactured by molding. In the cross sectional view of the three segment loudspeaker of FIG. 4, the parts are shaped for easy removal of the molded parts from the molds, and the two molds for forming tube 200 and combined tubes 300 and 400 will be suitably shaped and dimensioned as a negative of the shape of these parts. As illustrated in FIG. 4, a draft on the order of 6% is provided to allow for an easy removal of molded parts from the molds, according to standard production molding techniques. The molds can be made out of metal. In one embodiment, the molds are made out of aluminum. In one specific example, the dimensions of the molded parts may be based on the 3" Tangbang Model WS-881S Loudspeaker Driver.

Any suitable material may be used to mold tube 200 and to integrally mold the tubes 300 and 400. In one embodiment, RayCrete™ material from Valiant Technologies of San Diego, Calif. is used to mold the tube 200 and the integrally formed tubes 300 and 400. RayCrete™ is a two part, polyurethane based, structural filling adhesive compound. RayCrete™ changes its consistency over time. When the compound's components are initially mixed together, RayCrete™ is liquid enough to pour it into a mold. After 5 minutes from mixing the components, RayCrete™ compound becomes like a paste. Between 10-40 minutes, RayCrete™ is like clay or putty that can be trimmed or carved to reduce sanding time. At only 2 hours RayCrete™ is like a piece of wood that can be worked with power tools such as disc sanders, drills and lathes. When cured, RayCrete™ can be cut, sanded, drilled, shaved, painted, stained, turned on a lathe, and even nailed without shattering. RayCrete™ is fully cured in 24 hours. When applied directly to itself, RayCrete™ forms a seamless bond. It bonds to itself at any time during its curing cycle and it does not require any surface preparation. Alternatively, a variety of other plastics or even metals can be used to produce the folded, coaxial tubular loudspeaker transmission line. For example, to produce a relatively small enclosure, ABS plastic can be used. ABS is an easily machined, tough, low cost rigid thermoplastic material with high impact strength. It is ideal for turning, drilling, milling, sawing, die-cutting and shearing. Natural and black ABS are made from FDA approved material. ABS plastic has good chemical and stress cracking resistance to inorganic salt solutions, alkalis, acids, and some oils. ABS has also excellent abrasion resistance, electrical properties, moisture and creep resistance.

To ensure a consistent shiny surface of the enclosure components and to prevent the molded material from sticking to the mold, the internal surface of the mold can be upholstered with a liner made out of polycarbonate or other plastic. After the mold is prepared and the lining is inserted into the mold, the material used to construct the enclosure components is injected into the mold. Then, the material inside the mold is cured. After the material has cured, both the positive and the mold liner are removed from the mold. Then, the liner is discarded (or ground up for recycling).

Where the coaxial tubes forming the loudspeaker transmission line are made out of the RayCrete™ material, use of a liner is particularly critical. RayCrete™ material is very adhesive to metals, such as aluminum. To prevent RayCrete™ from sticking to the aluminum mold, the internal surface of the mold is upholstered with a liner made out of 5 mil (0.005" thick) polycarbonate or other plastic.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention.

Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A loudspeaker, comprising:

a loudspeaker driver having a front face at a front end and a base opposite the front face at a rear end of the driver;

a first tube having a first end secured to the base of the loudspeaker driver and having an open end opposite the first end;

a cover having a first end in which the driver is mounted, extending beyond the rear end of the driver and surrounding the first tube; and whereby a segment of a transmission line is defined by the gap between the first tube and the cover.

2. The loudspeaker of claim 1 further comprising an inner tube at least partially located within the first tube, having a smaller cross-sectional dimension than the first tube, having an open front end spaced from the base of the driver and extending therefrom to a second open end and being joined to the cover at a location distal to the first end of the cover, whereby successive segments of a transmission line are further defined by the gap between the first tube and the inner tube and the interior of the inner tube.

3. The loudspeaker of claim 2, wherein the first tube is secured only to the loudspeaker driver and is otherwise unconnected to and spaced from the cover and the inner tube.

4. The loudspeaker of claim 3, further comprising a second tube of larger cross sectional dimensions than the first tube, extending over the first tube from a rear end towards the front end of the driver, the rear end of the second tube being spaced from the open rear end of the first tube, and the second tube having an open front end secured to the driver.

5. The loudspeaker of claim 4, further comprising a fourth tube of larger cross sectional dimensions than the second tube, the fourth tube extending over at least part of the length of the second-tube and having a closed rear end spaced from the rear end of the second-tube and an open front end, the fourth tube defining a fourth segment of the transmission line extending from the open end of the inner tube between the rear ends of the second tube and fourth tube, and along the space between the second tube and fourth tube to the front end of the fourth tube.

6. The loudspeaker of claim 2, wherein the tubes are coaxial and concentric with the loudspeaker driver.

7. A loudspeaker, comprising:

a loudspeaker driver having a front end and a base opposite the front end;

a cover having a first end in which the driver is mounted, extending beyond the base of the driver;

a first tube within the cover, having a first end secured to the base of the loudspeaker driver and having an open end opposite the first end and not supported by the cover; and whereby successive segments of a transmission line are defined by the gap between the first tube and the cover and by the space within the first tube.

8. The loudspeaker of claim 7 further comprising an inner tube at least partially located within the first tube, having a smaller cross-sectional dimension than the first tube, having an open front end spaced from the base of the driver and extending therefrom to a second open end and being joined to the cover at a location distal to the first end of the cover, whereby successive segments of a transmission line are further defined by the gap between the first tube and the inner tube and the interior of the inner tube.

9. The loudspeaker of claim 7, wherein the first tube is secured only to the loudspeaker driver and is otherwise unconnected to and spaced from the cover and the inner tube.

10. The loudspeaker of claim 9, wherein the tubes are coaxial and concentric with the loudspeaker driver.

* * * * *